US008477162B1

(12) United States Patent
Martell et al.

(10) Patent No.: US 8,477,162 B1
(45) Date of Patent: Jul. 2, 2013

(54) THERMAL PRINTER WITH STATIC ELECTRICITY DISCHARGER

(75) Inventors: Robert W. Martell, Portland, OR (US); Mark E. Thueson, Ogden, UT (US); Kevin M. Parks, Portland, OR (US); Divyatej Tummala, Beaverton, OR (US); Daniel B. Meyer, Lake Oswego, OR (US); Timothy C. Martin, Portland, OR (US)

(73) Assignee: Graphic Products, Inc., Beaverton, OR (US)

( * ) Notice: Subject to any disclaimer, the term of this patent is extended or adjusted under 35 U.S.C. 154(b) by 17 days.

(21) Appl. No.: 13/371,833

(22) Filed: Feb. 13, 2012

Related U.S. Application Data

(60) Provisional application No. 61/553,016, filed on Oct. 28, 2011.

(51) Int. Cl.
*B41J 2/315* (2006.01)

(52) U.S. Cl.
USPC ..... 347/171

(58) Field of Classification Search
USPC .. 347/171, 199, 102, 33; 346/74.4; 400/118.3
See application file for complete search history.

(56) References Cited

U.S. PATENT DOCUMENTS 3,634,726 A 1/1972 Jay
4,110,810 A 8/1978 Moore et al.
4,214,211 A 7/1980 Yokogawa
4,329,071 A * 5/1982 Applegate et al. ..... 400/118.3
4,434,354 A 2/1984 Nakata
4,442,342 A 4/1984 Yoneda
4,494,166 A 1/1985 Billings et al.
4,517,143 A 5/1985 Kisler
4,523,252 A 6/1985 Wallén
4,556,890 A * 12/1985 Hermanson et al. ..... 346/74.4
4,573,058 A 2/1986 Brooks
4,602,311 A 7/1986 Lloyd et al.
4,707,153 A 11/1987 Nishi et al.
4,717,059 A 1/1988 Takahashi
4,760,492 A 7/1988 Walsh
4,810,432 A 3/1989 Kisler
4,918,464 A 4/1990 Isshiki
4,980,009 A 12/1990 Goodwin et al.
5,045,865 A * 9/1991 Crystal et al. ..... 347/114
5,084,831 A 1/1992 Morikawa et al.
5,095,400 A 3/1992 Saito
5,132,701 A 7/1992 Stephenson et al.
5,140,341 A 8/1992 Fiscella et al.
5,179,497 A 1/1993 Bakhoum
5,247,420 A 9/1993 Bakhoum
5,280,646 A 1/1994 Koyama et al.
5,321,627 A 6/1994 Reher
5,359,750 A 11/1994 Le Vantine
5,432,533 A 7/1995 Shibamiya
5,469,322 A 11/1995 Seo (Continued)

*Primary Examiner* — Kristal Feggins
(74) *Attorney, Agent, or Firm* — Klarquist Sparkman, LLP

(57) ABSTRACT

A thermal printer, when operating under battery power, has an internal or battery ground. Static electricity is typically generated during normal operation of the printer. At least one static electricity discharge member is positioned in contact with a major surface of printing substrate at a location downstream from the location at which a thermal print head transfers ink from an ink transfer ribbon to the substrate. The at least one static electricity discharge member is electrically coupled to the internal ground so as to discharge static electricity build up that can otherwise damage electronic components of the printer.

24 Claims, 11 Drawing Sheets

U.S. PATENT DOCUMENTS

RE35,214 E 4/1996 McGarry et al.
5,515,087 A 5/1996 Lim et al.
5,551,785 A 9/1996 Mori et al.
5,563,496 A 10/1996 McClure
5,606,242 A 2/1997 Hull et al.
5,606,243 A 2/1997 Sakai et al.
5,611,631 A 3/1997 Ooishi et al.
5,617,324 A 4/1997 Arai
5,659,349 A 8/1997 Albano et al.
5,669,720 A 9/1997 Negishi et al.
5,673,070 A 9/1997 Nakanishi et al.
5,682,504 A 10/1997 Kimura et al.
5,703,469 A 12/1997 Kinoshita
5,719,739 A 2/1998 Horiguchi
5,745,146 A 4/1998 Durst et al.
5,771,054 A * 6/1998 Dudek et al. ..... 347/102
5,811,890 A 9/1998 Hamamoto
5,835,107 A 11/1998 Suzuki et al.
5,840,452 A 11/1998 Kitagawa
5,844,884 A 12/1998 Szlenski
6,095,700 A 8/2000 Negishi et al.
6,120,864 A 9/2000 Chiricosta et al.
6,134,016 A 10/2000 Watanabe et al.
6,167,330 A 12/2000 Linderman
6,169,387 B1 1/2001 Kaib
6,232,747 B1 5/2001 Takahashi et al.
6,247,860 B1 6/2001 Yanagisawa
6,359,419 B1 3/2002 Verbrugge et al.
6,405,012 B2 6/2002 Ishikawa
6,444,102 B1 9/2002 Tucci et al.
6,515,464 B1 2/2003 Darmawaskita et al.
6,532,078 B2 3/2003 Hayama
6,549,947 B1 4/2003 Suzuki
6,647,242 B2 11/2003 Gagnon et al.
6,739,530 B1 5/2004 Shilton et al.
6,784,908 B2 8/2004 Shibuya
6,918,645 B2 7/2005 Takahashi
6,952,555 B2 10/2005 Oh et al.
6,961,075 B2 11/2005 Mindler et al.
7,014,375 B2 3/2006 Nagae et al.
7,052,105 B2 5/2006 Ushigome
7,235,949 B2 6/2007 Ikeda
7,307,592 B2 12/2007 Park et al.
7,330,802 B2 2/2008 Hsu
7,342,381 B2 3/2008 Johnson et al.
7,589,650 B2 9/2009 Hsien et al.
7,696,725 B2 4/2010 Liu et al.
7,711,401 B2 5/2010 Lim
7,768,233 B2 8/2010 Lin et al.
7,812,747 B2 10/2010 Chen
7,924,088 B1 4/2011 Chiang et al.
7,983,863 B2 7/2011 Jin et al.
8,032,040 B2 10/2011 Lee
2002/0057458 A1 5/2002 Davis et al.
2003/0007180 A1 1/2003 Urasawa et al.
2010/0165406 A1 7/2010 Purnomo

* cited by examiner

THERMAL PRINTER WITH STATIC ELECTRICITY DISCHARGER

CROSS REFERENCE TO RELATED APPLICATION

This application claims the benefit of U.S. Provisional Application Ser. No. 61/553,016, entitled THERMAL PRINTER WITH STATIC ELECTRICITY DISCHARGER, filed on Oct. 28, 2011, which is incorporated by reference herein.

TECHNICAL FIELD

This disclosure relates to thermal printers which transfer ink from an ink transfer ribbon to a substrate to print the substrate.

SUMMARY

A thermal printer is disclosed for transferring ink from an ink transfer ribbon to a substrate to print the substrate. The substrate has first and second opposed major surfaces which are movable through the printer in a downstream direction along a print flow path, it being understood that the print flow path need not be straight. The printer has a battery for providing battery power to the printer and an internal electrical ground coupled to the anode of the battery so as to be at the battery ground potential. A thermal print head in the print flow path is operable to heat the ink transfer ribbon to transfer ink to the substrate at a print location as the ink transfer ribbon and substrate travel relative to the thermal print head along the print flow path. At least one static electricity discharge member is positioned to contact the first major surface of the substrate at a location downstream along the print flow path from the print location as the substrate travels along the print flow path. The static electricity discharge member is electrically coupled to the internal electrical ground and operable to discharge static electricity to the internal electrical ground to thereby neutralize the static electricity charge.

In accordance with an embodiment, the static electricity discharge member can comprise a base with a plurality of electrically conductive bristles projecting outwardly from the base in contact with the first major surface of the printed substrate. The bristles can be positioned substantially in a row extending transversely to the direction of travel of the substrate. The bristles can be supported by the base so as to be skewed relative to the direction of travel of the substrate and can, in an alternative, be positioned to extend in a direction perpendicular to the direction of travel of the substrate. Desirably the bristles extend across at least a major portion of the first surface of the substrate, such as across a majority of the first surface of the substrate, and more desirably across the entire width of the surface of the substrate. Thus, the bristles in an embodiment can extend at least from side to side of the first major surface.

In accordance with a further embodiment, the at least one static electricity discharge member can comprise first and second static electricity discharge members or dischargers. The first static electricity discharge member can be positioned to contact the first major surface and the second static electricity discharge member can be positioned to contact the second major surface. The first and second static electricity discharge members can be positioned to contact the substrate surfaces at a location downstream along the print flow path from the print location. Both of the first and second static electricity discharge members are electrically coupled to the internal electrical ground. The term coupled in this disclosure includes direct connection from one component to another as well as indirect connection through one or more other components or elements. The term electrically coupled means that an electrically conductive flow path exists between components, such as from the electrical discharge members to the internal electrical ground. The first and second static electricity discharge members can, for example, comprise bristles arranged such as described above. The first and second static electricity discharge members can be elongated with an elongated static electrical discharge element such as bristles arranged and/or positioned in a row or other pattern. In one desirable embodiment, the bristles of first and second static electricity dischargers are positioned in respective rows on opposite sides of the substrate from one another with the rows being substantially in alignment with one another. The rows in this embodiment can be positioned directly across one another with the substrate positioned therebetween.

In accordance with yet another embodiment, such as in the case of a continuous roll form substrate, a cutter is desirably provided downstream in the print flow path from the thermal print head that is operable to cut the substrate following printing. For example, in the case of a label printer, each label that is printed can be separated by the cutter from the remaining substrate. The cutter can comprise metal or other electrically conductive material that is coupled to the internal ground. The one or more static electricity discharge members can be directly mounted to the cutter or electrically coupled to the cutter such that the cutter provides a static electricity discharge path from the one or more static electricity discharge members to the internal ground. The one or more static electricity discharge members can be positioned downstream along the print flow path from the cutter.

In accordance with a still further embodiment, the printer can comprise a housing and a substrate support rotatably coupled to the housing for supporting a roll of substrate to be printed. The substrate support can comprise a roll receiving rod or axle in one alternative and can alternatively comprise a spool or core on which the substrate is wound. In addition, in accordance with this embodiment, an ink transfer ribbon support can be rotatably coupled to the housing for supporting a roll of ink transfer ribbon. The ink transfer ribbon support can, in one alternative, comprise a rod or axle and can alternatively comprise a spool or core about which the ribbon of ink transfer ribbon is rolled. A thermal print head is positioned within and coupled to the housing in the print flow path. A platen, such as a rotatable roller, is positioned to engage a sandwich of the substrate and ink transfer ribbon that is unrolled from the respective substrate and ink transfer ribbon supports with the ink transfer ribbon being in contact with a major surface of the substrate. Rolling of the platen moves the engaged sandwich of the substrate and ink transfer ribbon along the print flow path relative to and in contact with the thermal print head. The thermal print head can be operable in a conventional manner to heat the ribbon to print the substrate at a print location in the print flow path. An ink transfer ribbon take up is rotatably coupled to the housing and, in one alternative, comprises a spool or spindle that is rotatably driven to take up the ink transfer ribbon as the ink transfer ribbon is separated from the substrate following printing by the thermal print head. A cutter can be positioned in the print flow path downstream from the thermal print head and is operable to sever the substrate to separate a portion of the substrate from the remaining roll. At least one electrically conductive static discharger is positioned in contact with at least one of the first and second major surfaces of the substrate with the electrically conductive static discharger being coupled to an electrical ground of a battery provided for providing power to the printer. An electrical flow path is thereby provided from the discharging static electricity discharger to the battery ground for static electricity that builds up on the substrate during printing. Desirably, the electrically conductive static discharger comprises at least one elongated static discharger that can comprise a brush comprising bristles positioned in contact with at least one of the first and second major surfaces of the substrate at a location downstream in the print flow path from the print location. These bristles are electrically coupled to the battery ground. The bristles can be arranged as previously described. In alternative embodiments, a plurality of electrically conductive static dischargers can be positioned on opposite sides of the substrate in electrical contact with the respective major surfaces of the substrate.

In accordance with still another embodiment, the bristles of static electricity discharge members can comprise carbon fibers. In addition, the platen can comprise a roller rotatably supported by a spindle with the spindle being electrically coupled to the battery ground. These bristles can be arranged in the forms of tufts spaced along a supporting base.

The disclosure also encompasses methods of operating a thermal printer wherein at least one major surface of a substrate is contacted by a static electricity discharger, such as electrically conductive bristles, and coupled to an internal electrical ground so as to discharge static electricity from the printed substrate.

These and other novel and non-obvious features and method acts will become more apparent from the description below and the drawings. The present invention encompasses all such novel and non-obvious method acts and features individually, as well as in combinations and sub-combinations with one another.

DETAILED DESCRIPTION

Figure 1:
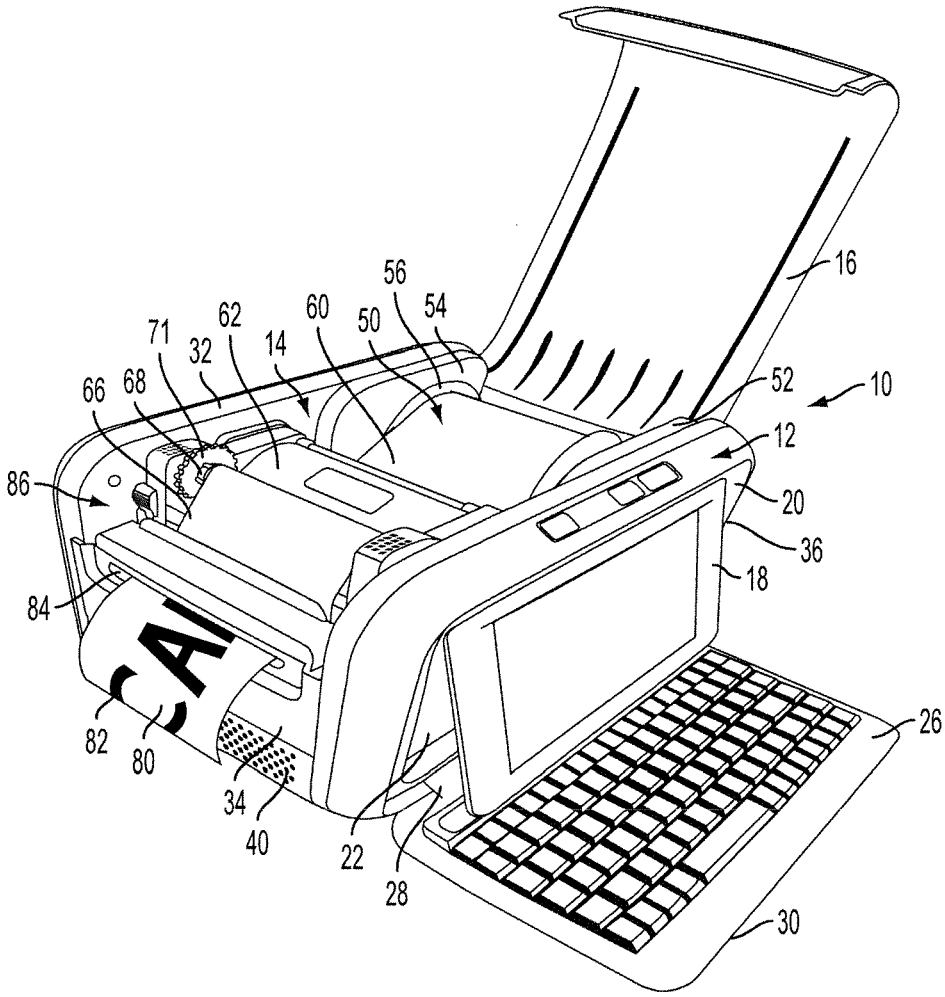
FIG. 1 is a perspective view of one embodiment of a thermal printer with a cover open to show selected components of the printer. The FIG. 1 embodiment illustrates a thermal printer with numerous ornamental features that can be modified without interfering with the functionality of the printer.
Figure 2:
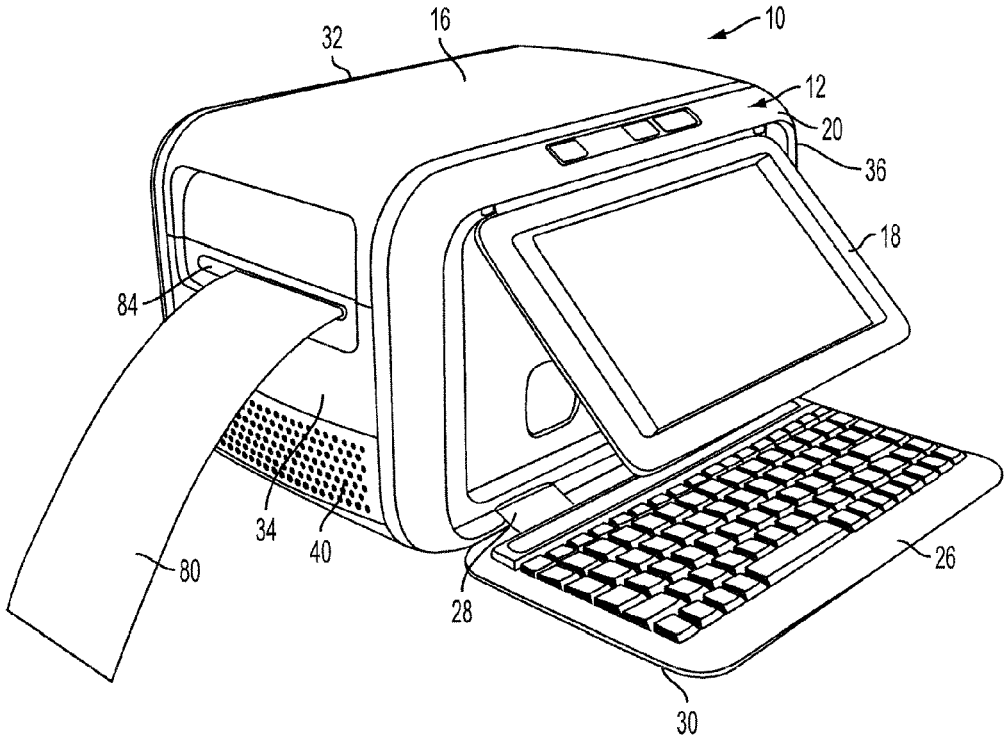
FIG. 2 is a perspective view of a thermal printer in accordance with FIG. 1 with the cover closed.
Figure 3:
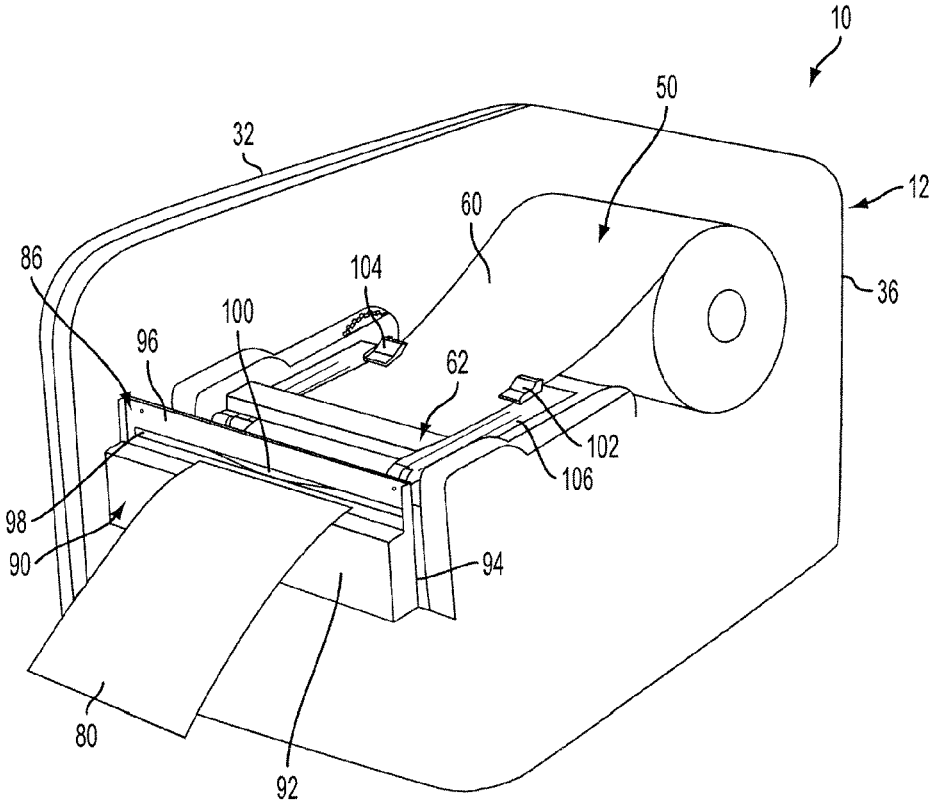
FIG. 3 is a partially broken away view of the printer of FIG. 1 with some components removed for convenience.

With reference to FIGS. 1-3, an exemplary thermal printer 10 comprises a housing 12 having an upwardly opening internal chamber 14 that is selectively closable by a cover 16 that can be pivoted to the housing. A display, such as a screen 18 is included in the illustrated printer. The display is shown positioned along a side wall 20 of the printer housing 12. Side wall 20 can include a recess 22 sized to receive the display when the display is moved from a deployed position as shown in FIG. 1, wherein the display is angled outwardly from side wall 20 from an upper portion of the recess 22, to a stowed position, wherein the display is positioned within the recess 22. The display 18 can be hinged or otherwise pivoted to the housing such as along its upper edge.

A data input device, which can take any suitable form, such as a keyboard, touch screen, or other data input is shown in FIG. 1. In FIG. 1, the data input device comprises a keyboard 26 that can be used, for example, to enter lettering or other messages to be printed by the printer onto print substrate as explained below. The keyboard 26 can be pivoted to the housing, such as by first and second hinges, one being indicated by the number 28 in FIG. 1, for pivoting about a pivot axis from a deployed position, such as shown in FIG. 1, to a stowed position wherein the keyboard is positioned against side wall 20 to thereby protect the keyboard and screen 18. In this example, the hinge 28 and a companion hinge allow pivoting of keyboard 26 about a longitudinally extending axis adjacent to a lower bottom edge of side wall 20. The axis about which keyboard 26 pivots can be parallel to and spaced from the axis about which screen 18 pivots. The bottom surface 30 of keyboard 26 can comprise a durable material, such as a relatively hard polymer or plastic to provide protection to the internal components when the display 18 and keyboard 26 are stowed.

The housing 12 also can comprise a durable material such as polymer or plastic. In addition to side wall 20, the illustrated housing 12 comprises an opposed side wall 32 spaced transversely from side wall 20 and first and second end walls 34, 36. Although not shown in FIG. 1, side wall 32 can comprise a recess for receiving a rechargeable battery that is the sole power source for the printer at least when the printer is not at a location where it can be plugged into a battery charger or other power source. In one desirable embodiment, the battery is the sole power source for the printer and must be removed for recharging. End wall 34 is provided with ventilation apertures 40 communicating with the interior of chamber 14 through which heat from the printer can dissipate.

In the thermal printer of FIGS. 1-3, substrate to be printed is moved through the printer along a print flow path. The thermal printable substrate can take any number of forms. For example, the substrate can comprise thermoplastic polymer films, sheets or fabrics. In one specific example, the substrate can comprise a multi-layered material, such as a plurality of thermoplastic layers of high density polyethylene (HDPE) that has been extruded, stretched, bias-cut and cross laminated into a composite structure that can comprise, for example, between thirteen and fifteen layers. Vinyl is another example of a suitable substrate. This disclosure is not dependent upon the type of substrate that is used. That is, the static discharge mechanism described herein can be present independently of the type of substrate regardless of whether printing with a particular type of substrate results in high levels of static electricity or minimal static electricity.

A thermal ink transfer ribbon is sandwiched with the substrate and moved relative to a thermal print head along the print flow path into contact with the print head. Thermal ink transfer ribbons are of varying constructions. In one specific example, the ink transfer ribbon comprises an ink carrier or backing ribbon of polyester with an ink coating on a first side of the backing ribbon that faces the printing substrate and is on the opposite side of the backing ribbon from a thermal print head. The second side of the ribbon, opposite to the first side and facing the thermal print head conventionally can be coated with a friction and static reducing back coat material to facilitate sliding of the ribbon across the surface of the thermal print head during printing. The ink coating will release from the carrier when heated to heat transfer the ink to the printing substrate. The operation of the thermal print head is controlled in a conventional manner to selectively heat the print head (e.g. individual pixels of the print head being heated as required to transfer portions of the ink from the ink transfer ribbon) to cause the transfer of ink from the ink transfer ribbon to the adjacent surface of the print substrate in the desired pattern to be printed thereon. The ink transfer ribbon is then separated from the substrate with the printed substrate exiting the printer. In the case of a continuous roll form substrate, a cutter can be included in the print flow path for cutting or separating pieces of the substrate, such as labels, following printing.

With reference to FIGS. 1 and 3, and keeping in mind that the disclosure is not limited to the use of roll form substrates or roll form ink transfer ribbons, a roll of substrate 50 is shown positioned within the housing 12. The substrate roll can be supported by a rod or axle coupled to the respective side walls 20, 32 of the housing, such as to interior wall portions 52, 54 that project inwardly from the respective side walls 20, 32. The substrate roll 50 is supported for pivoting about a transverse axis such as about an axis that is perpendicular to the longitudinal axis of the printer and to the direction of travel of the substrate. The substrate roll 50 can be supported by a reel 56, or a core not shown, on a pin or rod extending between wall portions 52, 54 so as to allow the roll to rotate about the support axis to unroll substrate from the substrate roll during printing. The supporting axle or rod can be rotatably coupled to side wall portions 52, 54 or the core or spool 56 can be rotatable about a fixed rod.

FIG. 1 shows a portion 60 of substrate being fed from roll 50 to the underside of a thermal print head 62 coupled to the housing 12. A roll of ink transfer ribbon, that can be rotatably supported in the same manner as substrate roll 50, is positioned within chamber 14 of housing 12 for supplying the ink transfer ribbon to be used in the printing operation (this ink ribbon supply roll is not shown in FIG. 1 for convenience, but is shown as ink transfer ribbon roll 61 in FIG. 5). The roll of ink transfer ribbon can be supported for rotation about a transverse axis parallel to the axis of rotation of substrate roll 50 for rotation about a transverse axis extending between wall portions 52 and 54. The ink transfer ribbon is positioned in contact with one major surface of the substrate and a sandwich of ink transfer ribbon and substrate is moved in contact with the thermal print head with the print head heating the ink transfer ribbon to transfer the desired print pattern to the major surface of the substrate. The substrate as shown in FIG. 1 has an upper major surface and a lower major surface, as well as side edges. The upper major surface is visible in FIG. 1.

In FIG. 1, ink transfer ribbon 66 is separated from the substrate at a location downstream from the location where printing occurs (where the ink transfer ribbon is heated). The used ink transfer ribbon is wound onto a rod 68 of an ink transfer ribbon take up mechanism. The ink transfer take up rod or axle can be driven, such as via an electric motor and a drive gear 70 to take up the slack in the ink transfer ribbon as the ribbon exits from contact with the thermal print head. The printed substrate 80, with printing 82 thereon, exits from the printer via a slot 84 in the end wall 34. In the case of continuous roll form substrates, a cutter, indicated generally at 86 can be included and operated to cut the substrate at a desired location to sever the printed substrate from the remainder of the substrate roll. For example, in the case of a label printer, the substrate can be severed following the printing of each label. Alternatively, the labels can be manually separated following printing.

FIG. 3 illustrates one form of a suitable cutter in greater detail. The illustrated form of cutter 86 comprises a housing 90 having a front wall 92 and a rear wall 94. A portion 96 of the rear wall projects upwardly from the main body of the housing 92. A slot 98 extends through rear wall 96. The slot is positioned in the print flow path downstream from the thermal print head such that the substrate is guided through the slot toward the exit slot 84 from the printer housing. A blade 100 is reciprocated to cut the substrate and sever the printed substrate 80 from the roll 50. For reasons that will become more apparent below, in one desirable embodiment the cutter housing 90 can comprise an electrically conductive material, such as aluminum or other metal, the housing can be coupled to an internal ground of the printer, corresponding to the ground of a battery providing power to the printer.

In FIG. 3, the substrate material 60 leaving the substrate roll 50 is guided by spaced apart guides 102, 104 that engage the upper major surface and side edges of the substrate. The side to side spacing of the guides 102, 104 can be varied to accommodate substrates of different widths. The lower major surface of the substrate is supported by support surface 106, such as a planar upper surface of a support 108 (see FIG. 5).

Figure 5:
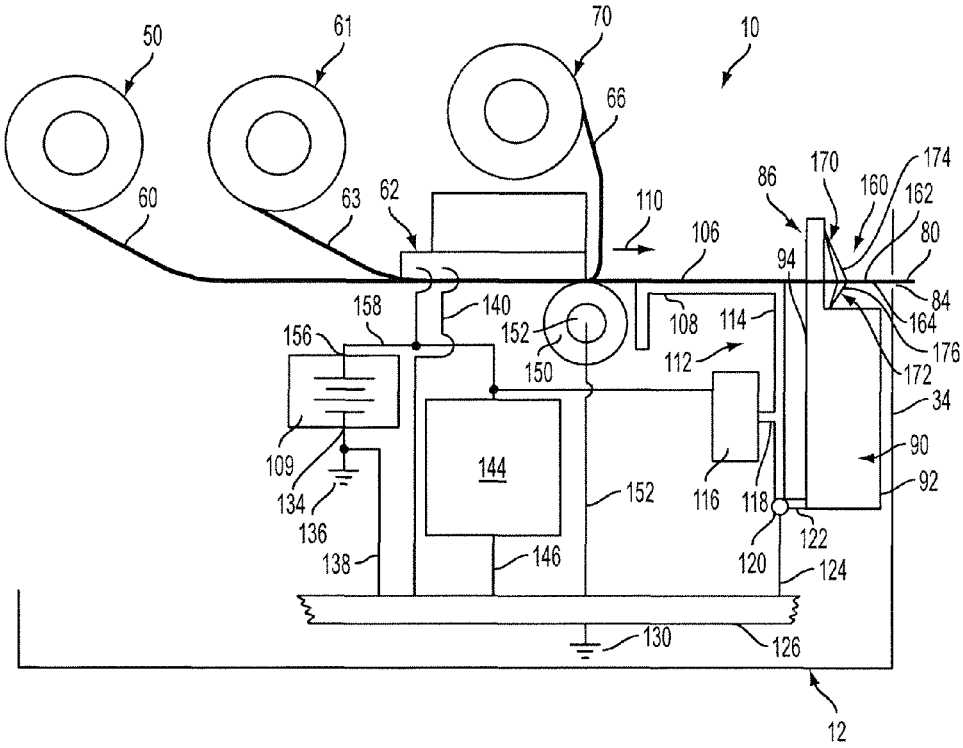
FIG. 5 is a side elevational view of an embodiment of a thermal printer that schematically illustrates a number of components of the printer.

As shown in FIG. 5, the support portion 108 can be a support plate portion with surface 106 positioned in the print flow path to provide support for the lower major surface of the substrate as it moves in the print flow path, such as in the downstream direction indicated by arrow 110 in FIG. 5. The support portion 108 can comprise an extension portion of a support bracket 112 and more specifically a projecting portion extending from the upper end of an upwardly extending portion 114 of the bracket 112. The bracket 112 is coupled to the housing 12. A cutter control circuit board 116 that provides control signals to the cutter to cause cutting of the substrate can also be supported by the support bracket 112, such as by a circuit board supporting extension portion 118 extending from the bracket portion 114 of the bracket 112. A pivot, such as a hinge 120 can be provided at a lower portion of the support portion 114. The housing 90 of the cutter 86 can be coupled by pivot 120 for pivoting about a transverse axis through the pivot 120, the transverse axis desirably being perpendicular to the direction 110 of substrate travel. The bracket 112 desirably comprises a cutter support portion 122, that extends from pivot 120 and supports the cutter housing 90. With this construction, the cutter housing can be pivoted (together with the support bracket 112) to provide access to the interior of the printer.

The bracket 112, pivot 120 and pivot extension 122, as well as the cutter housing 90, can all be of an electrically conductive material. The bracket can be electrically coupled, such as indicated schematically by a conductor 124 to an electrically conductive portion 126 of a chassis frame of the printer and an internal ground 130 of the printer. A battery 109 that provides power to the printer has an anode 134 corresponding to a battery ground 136 which is shown schematically coupled to the chassis or frame portion 126 such that the battery ground 136 corresponds to the internal ground 130 of the printer. The electrical connection of the battery ground 136 to the internal ground 130 is indicated schematically by the conductor 138 in FIG. 5. The thermal print head 62 is also electrically coupled, such as indicated schematically by conductor 140, to the internal ground. In addition, a main circuit board 144, is also electrically coupled, such as by a schematically indicated conductor 146 to the internal ground. The main circuit board provides control signals to cutter circuit board 116, controls the operation of the thermal print head 62, and receives inputs from the input device such as keyboard 26 (FIG. 1). In addition, although various mechanisms can be used for advancing a sandwich of substrate and ink transfer ribbon through the printer along the print flow path, in FIG. 5, a platen roller 150 is shown for this purpose. Roller 150 is driven by rotating the roller to move the substrate and ink transfer ribbon through the printer, such as in the direction of arrow 110. The platen can also be operated to reverse the direction of rotation of the platen if desired. The roller 150 can comprise a roller with a polymer exterior surface and can comprise rubber. The roller backs up the lower major surface of the substrate at or adjacent to the location where printing takes place. The platen can be drivenly supported by an axle or rod 152 that can comprise an electrically conductive material coupled to the internal ground. This coupling is represented schematically by a conductor 152 shown connecting the axle 152 to the frame portion 126 and thus to the internal ground 130. The cathode 156 of the battery 132 is shown schematically coupled to the thermal print head 62, the main circuit board 144 and to the cutter circuit board 116 by conductors collectively indicated by the number 158. Other powered components of the printer, such as a driver for platen 152 and the take up 170 are also electrically coupled to the battery by electrical conductors that are not shown. FIG. 5 also illustrates a roll of ink transfer ribbon 61 on an ink transfer ribbon support 63.

During printing by a thermal printer, static electricity can build up on the surfaces of the substrate, such as on the upper and lower major surfaces of the substrate in FIG. 5. Certain types of substrates are more prone to higher levels of static build up. The static electricity build up is particularly pronounced when certain types of substrates, such as vinyl, move through the print head and are printed thereon. In the case of a rolled substrate, the source of static electricity is not entirely clear. However, the static electricity may arise from unrolling of the substrate, from unrolling an ink transfer ribbon that is placed in contact with the substrate to form a sandwich of the ink transfer ribbon and substrate as it passes the thermal print head, from printing by the thermal print head and/or from the separation of the ink transfer ribbon from the sandwich following printing and prior to discharge of the printed substrate from the printer. Regardless of the source of the static electricity, it is possible for a charge in excess of 20 kilovolts to develop in the printer operated to continuously permit a roll of thirty feet of vinyl substrate. A static buildup of this magnitude, or a somewhat lower magnitude, if discharged in an uncontrolled manner, can damage printer circuitry. It is desirable that the static electricity be completely discharged from the printed substrate, although a discharge to a potential below about 8 kilovolts minimizes or eliminates the risk of damage to the printer from the static electricity. To reduce this build up to a level that is sufficiently low so as to prevent this damage, for example to a range of between positive or negative 8 kilovolts, an electrical static discharge mechanism is included in the embodiments of a thermal printer disclosed herein.

Figure 4:
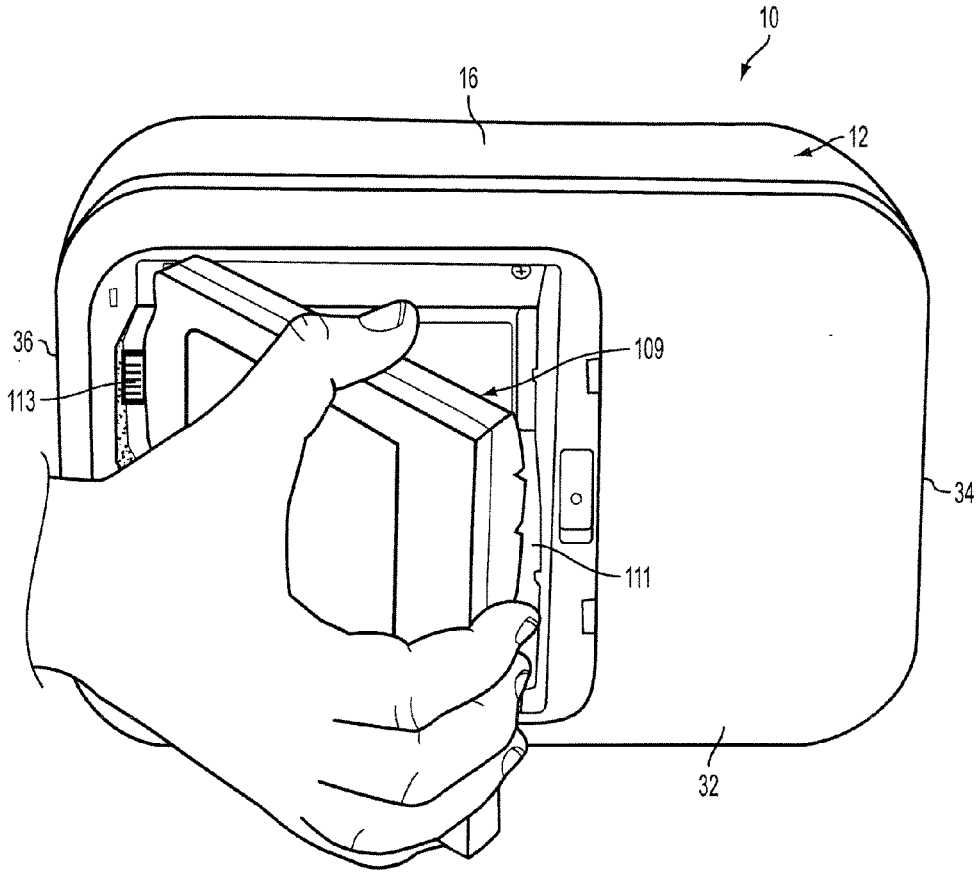
FIG. 4 is a perspective view of an exemplary thermal printer illustrating the insertion of a battery for powering the printer, into a battery receiving compartment of the printer housing.

FIG. 4 illustrates an exemplary printer looking toward side wall 32 thereof. Side wall 32 is provided with a recess or pocket 111 sized to receive a battery 109 inserted therein with terminals of the battery (anode and cathode terminals) connected to electrical contacts of circuitry within the printer, with one such contact being indicated at 113 in FIG. 4. The battery can be inserted and removed from the pocket 111 for recharging or replacement as needed. The battery 109 can comprise any suitable portable power source, such as a lithium or metal hydride battery, or a fuel cell electrical power supply.

When the printer is being operated in a standalone mode of operation powered solely by power from a battery 109, the internal electrical ground 130 is the only electrical ground for the printer as the printer is not connected to a power grid and thus is not connected to the external electrical ground of the power grid. If the battery is being charged by a battery charger from the electrical grid, such as from an A/C to D/C converter coupled to the grid, the internal electrical ground can be connected to the grid ground with power for the printer being available from the battery. In this case, as an alternative, the power can be supplied from the A/C to D/C converter output or from the battery output, whichever is at the highest potential. As another alternative, the printer can be powered solely by the battery, with the battery being required to be removed from the printer for recharging. In this latter example, the only effective electrical ground for the printer is the internal electrical ground.

Figure 4A:
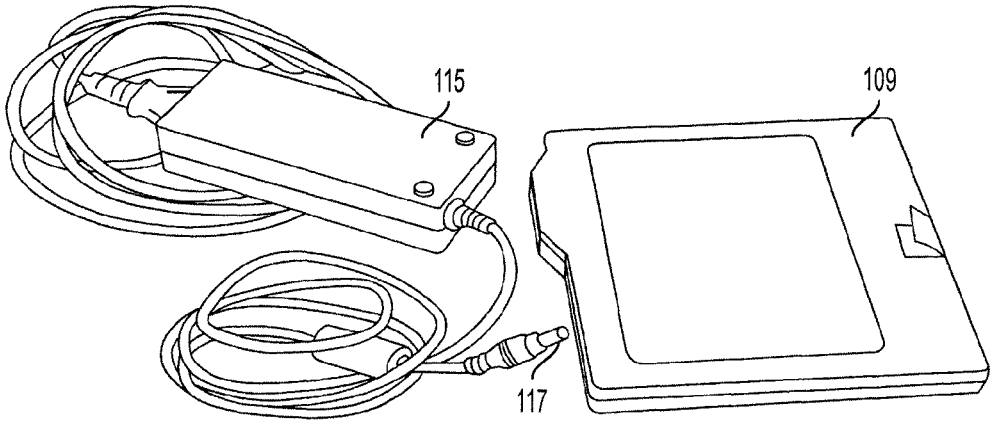
FIG. 4A is a perspective view of a battery that can be used in the printer of FIG. 1 for providing electrical power to the printer, together with a charger that can be used to charge the battery.

FIG. 4A illustrates the battery 109 removed from the printer housing 12. A battery charger 115 having a charging connecting 117 for coupling to a charging input port of battery 109 is shown. The battery charger can be plugged into a standard A/C outlet to provide charging power to the battery. Alternatively, a vehicle charger can be used. The battery can be configured with a charging input that allows charging of the battery without removal of the battery from the thermal printer.

With further reference to FIG. 5, a static discharge mechanism 160 is provided to discharge (which includes neutralizing) static charge on the major surfaces 162, 164 of the substrate between the side edges thereof that would otherwise develop during printing. During such printing, typically a positive static electricity charge would otherwise build up on these surfaces.

In accordance with this disclosure, a static discharge mechanism comprises at least one static electricity discharger positioned to engage at least one of the first and second major surfaces 162, 164 to sweep or discharge static electricity from the engaged major surface or surfaces. It has been found that discharging of some static electricity charge occurs if only one of the major surfaces is engaged by a static electricity discharger. However, a more complete discharge of static electricity takes place if a first static electric discharger engages one of the major surfaces and a second electric static discharger engages the other of the major surfaces.

Figure 6:
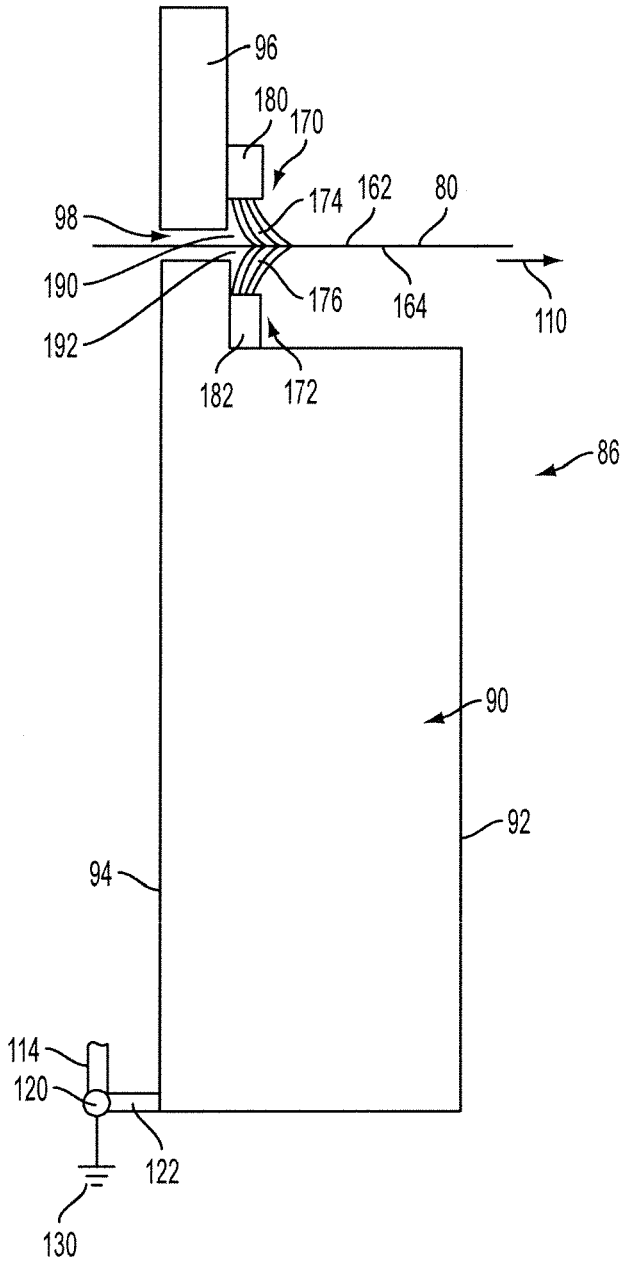
FIG. 6 is a schematic side elevational view of a cutter that can be included in a printer for separating the substrate into pieces, such as separating a printed label from remaining portions of the substrate, with FIG. 6 illustrating first and second exemplary static electricity dischargers mounted to the cutter.

In accordance with an embodiment, the static electric dischargers can each comprise an electrically conductive static electricity discharge element that contacts a respective major surface of the substrate and that is electrically coupled to the internal ground. In one specific example, the discharge elements can comprise one or more brushes, such as two brushes 170, 172 shown in FIG. 5. The brush or brushes 170 comprises a plurality of electrically conductive bristles 174 that contact the upper major surface 162 of the substrate 80. In addition, the one or more brushes 172 comprise a plurality of bristles 176 in contact with the lower major surface 164 of the substrate 80. The static electric discharge members are desirably positioned downstream from the print location where ink is transferred from the ribbon to the substrate. In FIG. 5, the brush type electric discharge members 170, 172 are positioned such that the bristles engage the respective major surfaces 162, 164 of the substrate at a a location downstream from the cutter 86 that cuts the substrate from the roll. Alternatively, the brush type electric discharge elements can be mounted to the opposite side of the cutter to position the bristles at a location upstream from the cutter. In addition, as another alternative, the brushes can be supported at locations spaced from the cutter, either upstream (between the print location and the cutter) or downstream from the cutter. As can be seen in FIG. 6, these static electricity discharge elements can comprise a base, for example base 180 for discharger 170 and base 182 for discharger 172. Base 180 supports bristles 174 so as to project outwardly from the base and toward the associated major surface 162 with tip portions of the bristles 174 contacting the surface 162. Similarly, bristles 176 are supported by base 182 so as to project outwardly from the base toward the major surface 164 of the substrate with tip portions of the bristles 176 contacting the major surface 164. As the substrate 80 travels in the direction 110, the bristles of the embodiment shown in FIG. 6 have sufficient flexibility so as to bend as shown with the tips of the bristles engaged by the substrate surfaces moving in a downstream direction. In this example, an acute angle 190 exists between tip portions of the bristles 174 and the upper surface 162 and a similar acute angle 192 exists between the tip portions of bristles 176 and the contacted surface 164.

The bristles 174, 176 are comprised of electrically conductive materials. In addition, in this example, the respective bases 180, 182 can also be comprised of electrically conductive materials. In this example, with a cutter housing 90 comprising electrically conductive materials, an electrically conductive flow path is provided from the surfaces of the substrate via the respective bristles and bases and the cutter housing and the support 122 to the internal ground 130. As a result, the static electric charge is in effect coupled to ground and discharged or neutralized from the surface of 162, 164 to a sufficient level (e.g., less than 8 kilovolts) so as not to risk damage to printer electronic components. The electric discharge members, such as bristles 174, 176 can be coupled to the internal ground other than through the cutter housing.

Desirably, resistance between the tips of the bristles and the internal ground is less than about 200 ohms. Although other materials can be used for the bristles 174, 176, one specific exemplary material comprises carbon fiber brush hairs having a diameter of approximately 0.01 mm and a length of approximately 8.26 mm. These hairs can be provided at a density of, for example, about 10,000 hairs per lineal inch of base. Alternatively, the bristles can be provided in the form of tufts or bunches of bristles mounted to the base at spaced locations along the base with, for example, a spacing of approximately 5 mm per tuft and 1500 bristles per tuft. The length of the bases and brushes can be varied. For example, a length of about 4.25 inches can be used for printing labels of a width (in a direction transverse to the direction of 110) that is about 4.25 inches, although static electric discharge will also take place if a substrate has a width that is narrower or wider than the width of the brushes. It is however desirable that the brushes be at least within 80 percent of the overall width of the substrate. The brushes are desirably positioned and supported such that the bristles lightly contact the upper and lower surfaces of the substrate.

It should be noted that the bristles can be of other materials, such as copper, although copper bristles have been found to be less effective than carbon bristles. In addition, stainless steel bristles, although suitable to discharge some static electricity, can mar the surface of the substrate because of the hardness of the stainless steel. As another alternative, the electrically conductive elements can be electrically conductive fabric, such as comprised of woven carbon or other electrically conductive materials, such as in sheet form. Static electricity dischargers comprising bristles as the discharge elements are particularly desirable.

The static electricity dischargers of the approach disclosed herein do not require electric power to operate to discharge static electricity. Thus, these passive static electricity dischargers do not suffer from the drawback of requiring electrical power to operate which would shorten the length of time the printer can be used between battery recharges.

Figure 7:
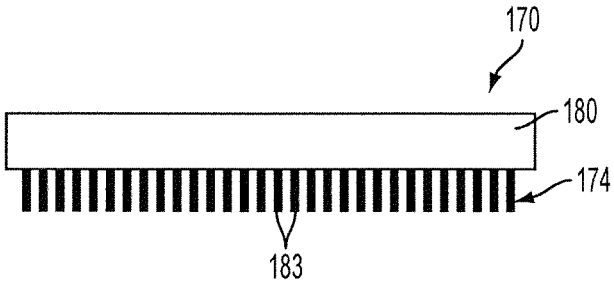
FIG. 7 is a front elevational view of one form of a static electricity discharge member usable in the embodiments of FIG. 1 and FIG. 5 to discharge static electricity from the substrate.

FIG. 7 illustrates one exemplary form of a brush type electrical discharge member 170 having an elongated base 180 and a plurality of bristles 176. The bristles 176 are shown in the embodiment of FIG. 7 in the form of tufts of plural bristles, some of these tufts being indicated by the number 182 in this figure.

Figure 8:
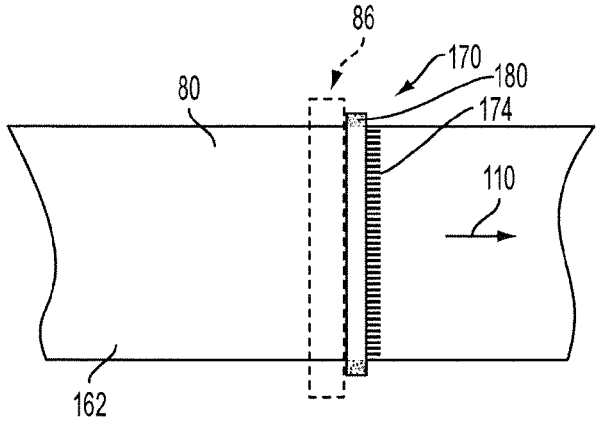
FIG. 8 is a top view of one embodiment of a static electricity discharge member in contact with a major surface of printing substrate.

Various exemplary embodiments of static electricity discharge members are shown in FIGS. 8-18. In FIG. 8, a static electricity discharge member 170 is shown having a base 180 that extends in a direction that is transverse to, and in this example perpendicularly to, the downstream direction of travel 110 of the substrate 80. The static electricity discharge member 170 comprises bristles 174, such as described above, extending along substantially the full length of the base 180 and beyond the side edges of the substrate 80. The bristles intermediate the side edges of the substrate are bent by the substrate as the substrate moves in the direction of arrow 110 such as previously explained in connection with FIG. 6. The same and/or a different form of static electricity discharge member can contact the lower surface of the substrate. In the FIG. 8 example, like in FIG. 6, the base 180 is mounted to the print head. It should be understood that the bristles can be supported directly by a component of the print head without a base.

Figure 9:
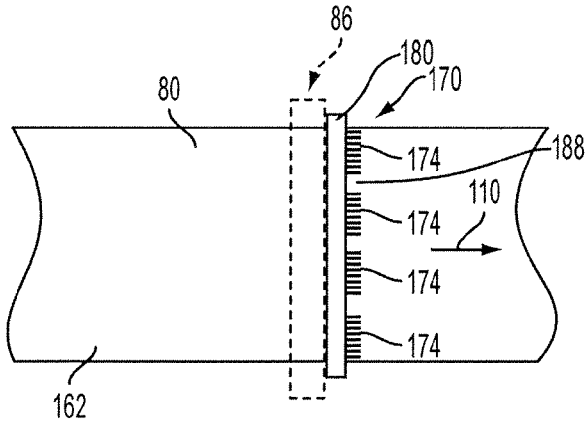
FIG. 9 is a top view similar to FIG. 8, but showing an alternative form of static electricity discharge member.

In FIG. 9, the bristles are arranged in segments with gaps, one such gap being indicated at 188, between the bristle segments. In the embodiments of FIGS. 8 and 9, the bristles are arranged in a row extending across the substrate and, in these examples, in a row that is aligned in a direction perpendicular to the downstream direction 110.

Figure 10:
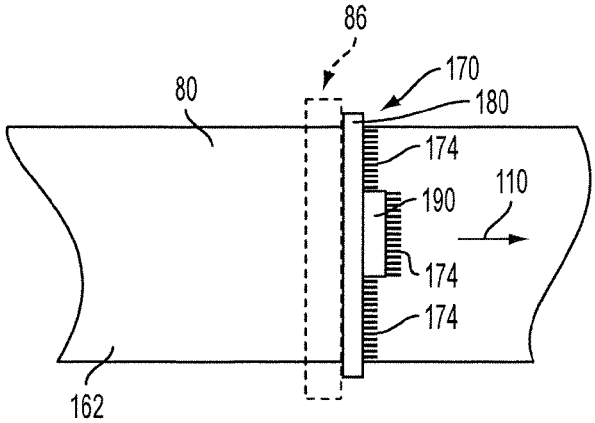
FIG. 10 is a view like FIG. 8, but showing yet another form of static electricity discharge member.

In the embodiment of FIG. 10, the base 180 has a downstream projecting central portion 190. In this embodiment, bristles extend from side portions and the central portion of the base. In FIG. 10, the bristles are not aligned in a row.

Figure 11:
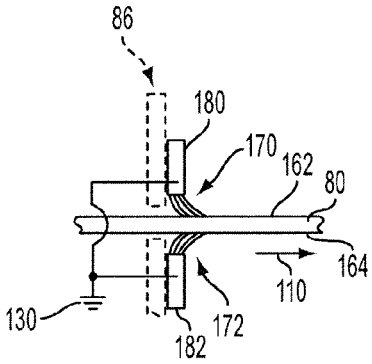
FIG. 11 is a side elevational view of substrate passing between first and second static electricity dischargers coupled to a grounded cutter and wherein the static electricity dischargers are stacked or aligned with one another.
Figure 12:
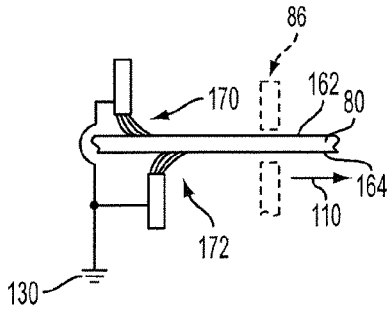
FIG. 12 is a view similar to FIG. 11 with the static electricity dischargers positioned at respective locations that are staggered from one another in the direction of travel of the substrate.
Figure 13:
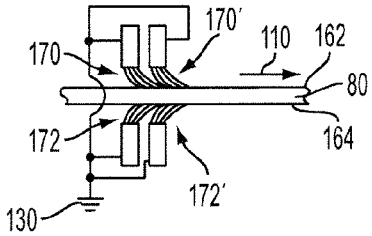
FIG. 13 illustrates a plurality of static electricity dischargers coupled to the upper surface of a substrate and a plurality of static electricity dischargers coupled to the lower surface of the substrate.

In the example of FIG. 11, which is similar to the example of FIG. 6, the bases 180, 182 are shown coupled to the internal ground 130 other than through components of the cutter. In the example of FIG. 11, the bristles of static electricity discharger 170 are in a first row and the bristles of static electricity discharger are in a second row with the two rows being aligned with one another. That is, the two rows are positioned directly across the substrate from one another. This construction has proven to be more effective than the construction of FIG. 12 in which the bristles of the first static electricity discharge member 170 are in a row staggered from a row containing the bristles of the second static electricity discharge member 170. In FIG. 12, the static electricity discharge members 170, 172 are shown upstream from the cutter and downstream from the print location. In the embodiment of FIG. 13, plural spaced apart electric discharge members 170, 170' are shown contacting the first major surface 162 of the substrate and plural spaced apart static electricity discharge members 172, 172' are shown contacting the second major surface 164 of the substrate 80. The discharge members 170, 170' can comprise respective parallel rows of bristles and the discharge members 172, 172' also can comprise respective parallel rows of bristles.

Figure 14:
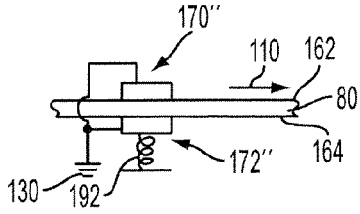
FIGS. 14 and 15 illustrate additional embodiments of static electricity dischargers electrically coupled to major surfaces of the substrate.

In FIG. 14 a first static electricity discharge member 170", comprising an electrically conductive element such as electrically conductive fabric of carbon or other material, or an electrically conductive bar such as a carbon bar, is shown in contact with the upper major surface 162 of the substrate 80. In addition, the lower static electricity discharge member 172" is shown with a similar electrically conductive static electricity discharge element held by a spring 192 against the lower major surface 164 of the substrate 80.

Figure 15:
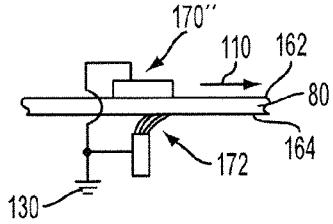

FIG. 15 illustrates an embodiment wherein the static electricity discharge elements contacting the opposed major surfaces of the substrate are not identical. In FIG. 15, a static electricity discharge member 170', such as described above in connection with FIG. 14, is shown contacting surface 162. In addition, a static electricity discharge member 172, such as described above in connection with FIG. 6, is shown contacting the opposed lower major surface 164 of the substrate 80.

It should be noted in this disclosure that the references to "contacting a major surface" does not preclude a static electricity discharge member from contacting other surfaces of the substrate such as one or both side edges of the substrate or more than one of the major surfaces of the substrate.

Figure 16:
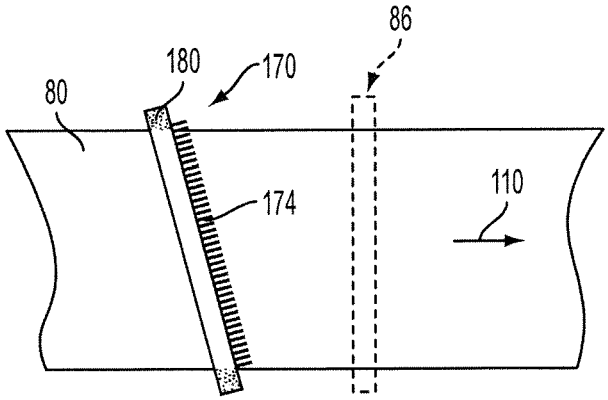
FIG. 16 is a top view of a static electricity discharger shown skewed relative to the direction of travel of the substrate and extending transversely relative to the substrate.

FIG. 16 illustrates a static electricity discharge member 170 comprising an elongated base 180 and projecting bristles 174 with the bristles 174 in a row that is skewed relative to the downstream direction of travel 110 of the substrate 80. In the embodiment of FIG. 16, the bristles 174 extend transversely across the entire width of the substrate. Also, in FIG. 16 the static electricity discharge member is shown upstream from the cutter 86.

Figure 17:
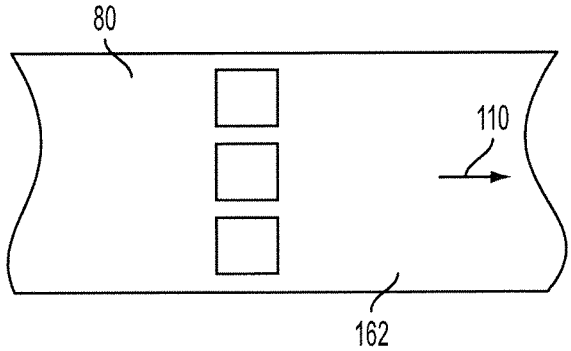
FIG. 17 illustrates a substrate footprint of static electricity dischargers of yet another form comprising a plurality of individual dischargers each having discharge elements of a square configuration.
Figure 18:
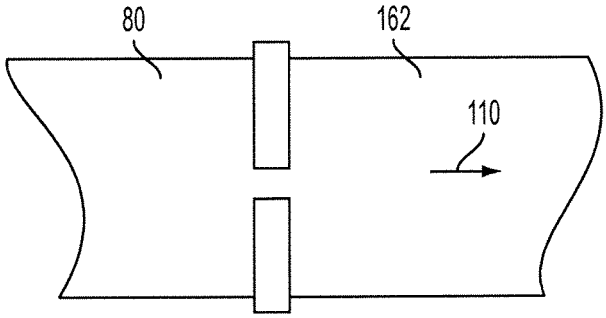
FIG. 18 is similar to FIG. 17 except illustrating the footprint of static electricity dischargers having discharge elements of yet another form.

FIGS. 17 and 18 schematically show exemplary footprints of electrically conductive elements on the major surface 162 of the substrate 80 of additional alternative static electricity discharge member embodiments. In the embodiment of FIG. 17, bristles or other electrically conductive elements contact a surface 162 in square contact areas. In FIG. 18, the contact areas are rectangular.

Throughout this disclosure, when a reference is made to the singular terms "a", "and", and "first", it means both the singular and the plural unless the term is qualified to expressly indicate that it only refers to a singular element, such as by using the phrase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the term "includes" has the same meaning as comprises.

Having illustrated and described the principles of our invention with reference to a number of embodiments, it should be apparent to those of ordinary skill in the art that the embodiments may be modified in arrangement and detail without departing from the inventive principles disclosed herein. We claim as our invention all such embodiments as fall within the scope of the following claims.

We claim:

1. A thermal printer for transferring ink from an ink transfer ribbon to a substrate to print the substrate, the substrate having first and second opposed major surfaces and being movable through the printer downstream along a print flow path, the printer having a battery for providing battery power to the printer and an internal electrical ground, the printer comprising:

a thermal print head in the print flow path operable to heat the ink transfer ribbon to transfer ink to the substrate at a print location as the ink transfer ribbon and substrate travel relative to the thermal print head along the print flow path; and at least one static electricity discharge member positioned to contact the first major surface of the substrate at a location downstream along the print flow path from the print location as the substrate travels along the print flow path, the static electricity discharge member being electrically coupled to the internal electrical ground.

2. A thermal printer according to claim 1 wherein the at least one static electricity discharge member comprises a base with a plurality of electrically conductive bristles projecting outwardly from the base in contact with the first major surface of the printed substrate.

3. A thermal printer according to claim 2 wherein the bristles are positioned substantially in a row extending transversely to the direction of travel of the substrate.

4. A thermal printer according to claim 3 wherein the bristles extend at least from side to side of the first major surface.

5. A thermal printer according to claim 2 wherein the bristles are supported by the base so as to extend across at least a major portion of the first surface of the printed substrate in a direction perpendicular to the direction of travel of the substrate.

6. A battery powered thermal printer according to claim 1 wherein the at least one static electricity discharge member comprises first and second static electricity discharge members, the first static electricity discharge member being positioned to contact the first major surface of the substrate, the second static electricity discharge member being positioned to contact the second major surface of the substrate at a location downstream along the print flow path from the print location, and the second static electricity discharge member being electrically coupled to the internal electrical ground.

7. A thermal printer according to claim 6 wherein each of the first and second static electricity discharge members comprises a base with a plurality of electrically conductive bristles projecting outwardly from the base, the bristles of the first static electricity discharge member being positioned for contact with the first major surface of the substrate and bristles of the second elongated static electricity discharge member being positioned for contact with the second major surface of the substrate, and wherein the bristles of each of the static electricity discharge members are positioned along respective rows that extend in a direction that is transverse to the direction of travel of the substrate along the print flow path.

8. A thermal printer according to claim 7 wherein the bristles of the first and second electrically conductive static discharge members are positioned in respective rows on opposite sides of the substrate from one another with the rows being substantially in alignment with one another.

9. A thermal printer according to claim 1 comprising a cutter located downstream in the print flow path from the thermal print head and operable to cut the substrate, wherein the at least one static electricity discharge member is mounted to the cutter and wherein the cutter is electrically coupled to the internal electrical ground, the at least one static electricity discharge member being electrically coupled to the internal electrical ground through the cutter.

10. A thermal printer according to claim 1 comprising a cutter located downstream in the print flow path from the thermal print head and operable to cut the substrate, wherein the at least one static electricity discharge member is positioned downstream along the print flow path from the cutter.

11. A thermal printer for transferring ink from an ink transfer ribbon to a major print surface of a substrate, the substrate comprising first and second opposed major surfaces, the printer having a battery for providing power to the printer and the battery having a battery ground, the printer comprising:

a housing;

a substrate support rotatably coupled to the housing for supporting a roll of substrate to be printed;

an ink transfer ribbon support rotatably coupled to the housing for supporting a roll of ink transfer ribbon;

a thermal print head positioned within the housing;

a platen positioned to engage a sandwich of the substrate and ink transfer ribbon unrolled from the respective substrate and ink transfer ribbon supports with ink transfer ribbon in contact with the major surface of the substrate, the platen being rotatably coupled to the housing and rotatable to move the engaged sandwich of the substrate and ink transfer ribbon in a print flow path relative to and in contact with the thermal print head, the thermal print head being operable to heat the ribbon to print the substrate at a print location in the print flow path;

an ink transfer ribbon take up rotatably coupled to the housing and positioned to receive ink transfer ribbon separated from the substrate following printing by the thermal print head;

a cutter in the print flow path downstream from the thermal print head and operable to sever the substrate to separate a portion of the substrate; and at least one elongated electrically conductive static discharger comprising a brush comprising bristles positioned in contact with at least one of the first and second major surfaces of the substrate at a location downstream in the print flow path from the print location, wherein the bristles are electrically coupled to the battery ground.

12. A thermal printer according to claim 11 wherein the at least one elongated electrically conductive static discharger comprises a first and second of said electrically conductive static dischargers comprising respective first and second brushes with bristles, the bristles of the first brush being in contact with the first major surface of the substrate and the bristles of the second brush being in contact with the second major surface of the substrate, the bristles of the first and second brushes being positioned to extend across at least a major portion of the substrate in a direction skewed from the direction of travel of the substrate.

13. A thermal printer according to claim 12 wherein the bristles of the first and second brushes extend across at least a major portion of the substrate in a direction that is perpendicular to the direction of travel of the substrate.

14. A thermal printer according to claim 12 wherein the bristles of the first brush are positioned in substantial alignment with the bristles of the second brush on opposite sides of the substrate from one another.

15. A thermal printer according to claim 12 wherein the bristles comprise carbon fibers.

16. A thermal printer according to claim 12 wherein each brush comprises an elongated base supporting tufts of bristles spaced along the base.

17. A thermal printer according to claim 12 wherein the platen comprises a roller rotatably supported by a spindle, the spindle being electrically coupled to the battery ground.

18. A thermal printer according to claim 12 wherein each of the brushes are mounted to the cutter and the cutter is electrically coupled to the battery ground and the bristles of the brushes are coupled to the battery ground through the cutter.

19. A thermal printer according to claim 18 wherein the platen comprises a roller rotatably supported by a spindle, the spindle being electrically coupled to the battery ground.

20. A method of operating a thermal printer comprising:

moving a substrate and a contacting thermal ink containing ribbon in a downstream direction along a print path through a printer housing of the printer;

heating the thermal ink containing ribbon in contact with the substrate with a thermal print head to cause the transfer of ink from the ribbon to the substrate to print the substrate;

separating the ribbon from the substrate following the printing of the substrate;

cutting the substrate to a desired length at a location along the print path that is downstream from the print head; and contacting at least one major surface of the substrate following printing by the print head with electrically conductive bristles coupled to an internal electrical ground of the printer so as to discharge static electricity from the printed substrate.

21. A method according to claim 20 wherein the act of contacting at least one major surface of the substrate following printing comprises contacting a first major surface of the substrate following printing with a first elongated set of electrically conductive bristles coupled to the internal electrical ground of the printer and contacting a second major surface of the substrate opposed to the first major surface following printing with a second elongated set of electrically conductive bristles coupled to the internal electrical ground of the printer, the first and second sets of electrically conductive bristles static electricity from the substrate.

22. A method according to claim 21 wherein the sets of bristles are in substantial alignment with one another on opposite sides of the substrate.

23. A method according to claim 22 wherein the sets of bristles are positioned in respective rows extending transversely to the direction of travel of the substrate along the print flow path.

24. A method according to claim 23 wherein the act of cutting comprises operating a cutter to cut the substrate, the cutter being electrically coupled to the internal electrical ground of the printer and the bristles being electrically coupled to the cutter so as to be electrically grounded through the cutter to the internal electrical ground.

* * * * *